US006412557B1

(12) United States Patent
Ayasse et al.

(10) Patent No.: US 6,412,557 B1
(45) Date of Patent: Jul. 2, 2002

(54) OILFIELD IN SITU HYDROCARBON UPGRADING PROCESS

(75) Inventors: Conrad Ayasse, Calgary (CA); Malcolm Greaves, Bath (GB); Alex Turta, Calgary (CA)

(73) Assignee: Alberta Research Council Inc., Edmonton (CA)

( * ) Notice: Subject to any disclaimer, the term of this patent is extended or adjusted under 35 U.S.C. 154(b) by 0 days.

(21) Appl. No.: 09/581,010

(22) PCT Filed: Dec. 4, 1998

(86) PCT No.: PCT/CA98/01127

§ 371 (c)(1),
(2), (4) Date: Aug. 25, 2000

(87) PCT Pub. No.: WO99/30002

PCT Pub. Date: Jun. 17, 1999

Related U.S. Application Data

(60) Provisional application No. 60/069,182, filed on Dec. 11, 1997.

(51) Int. Cl.[7] ..... E21B 43/243

(52) U.S. Cl. ..... 166/261; 166/262; 166/272.3; 166/245

(58) Field of Search ..... 166/256, 261, 166/262, 272.3, 245

(56) References Cited

U.S. PATENT DOCUMENTS

| | | | | |
|---|---|---|---|---|
| 3,017,168 A | | 1/1962 | Carr | |
| 4,434,851 A | | 3/1984 | Haynes, Jr. et al. | 166/272 |
| 4,466,485 A | | 8/1984 | Shu | 166/272 |
| 4,469,177 A | | 9/1984 | Venkatesan | 166/261 |
| 4,706,751 A | | 11/1987 | Gondouin | 166/272 |
| 5,054,551 A | | 10/1991 | Duerksen | 166/272 |
| 5,211,230 A | | 5/1993 | Ostapovich et al. | 166/245 |
| 5,273,111 A | | 12/1993 | Brannan et al. | 166/245 |
| 5,339,897 A | * | 8/1994 | Leaute | 166/245 |
| 5,626,191 A | * | 5/1997 | Greaves et al. | 166/245 |
| 5,824,214 A | * | 10/1998 | Paul et al. | 208/107 |
| 5,871,637 A | * | 2/1999 | Brons | 208/283 |

OTHER PUBLICATIONS

J.G. Weissman et al, "Down–Hole Catalytic Upgrading of Heavy Crude Oil", Energy and fuels, 1996.*

Gray, Murray et al. "Kinetics of hydrodesulfurization of thiophenic and sulfide sulfur in Athabasca bitumen" May 1995, *Energy & Fuels* May–Jun. 1995 ACS, Washington, D.C., vol. 9, Nr. 3, pp. 500–506.

* cited by examiner

*Primary Examiner*—William Neuder
(74) *Attorney, Agent, or Firm*—Kurt D. Van Tassel; Deborah G. VandenHoff; Van Tassel & Associates

(57) ABSTRACT

A well configuration is provided comprising an injection well (102) completed relatively high in an oil reservoir (100) and a production well (103–106) completed relatively low in the reservoir (100). The production well has a horizontal leg (107) oriented generally perpendicularly to a generally linear and laterally extending, upright combustion front propagated from the injection well (102). The leg (107) is positioned in the path of the advancing front. Oil upgrading catalyst has been emplaced along the horizontal leg. The production well (103–106) is maintained open, thereby providing a low pressure sink which induces the front to advance along the leg. The hot combustion gases react with the commingled oil over the catalyst to provide in situ upgrading.

16 Claims, 6 Drawing Sheets

OILFIELD IN SITU HYDROCARBON UPGRADING PROCESS

This application claims benefit of provisional application No. 60/069,182 filed Dec. 11, '97

FIELD OF THE INVENTION

This invention relates to a catalytic in situ process for upgrading hydrocarbons in an underground reservoir. More particularly, it relates to a process in which a catalyst is placed along the horizontal segment of a horizontal production well operating in a toe-to-heel configuration, which enables carbon monoxide and/or hydrogen produced in the reservoir or injected into the reservoir with steam, to pass sequentially with reservoir oil over the catalyst, immediately prior to being produced.

BACKGROUND OF THE INVENTION

Large supplies of heavy oil (ca. 8 to 15 degrees API) and medium oil (ca. 15–25 API) exist throughout the world, most notably in Venezuela, Canada and the U.S.A. Significant deposits are also to be found in the North Sea, China and Romania. The composition of the crude oil barrel is inexorably moving towards this heavier material, but it is relatively uneconomic to produce. Without upgrading to produce an oil of lighter composition, i.e. containing more white oil distillates (gasoline, diesel, etc.), heavy oil has very limited potential, historically trading at around $9.00 below the price of conventional oil. While surface upgrading technology (H-Oil, Vega-Combi or LC Fining processes) is possible, the payout time on the very large investment required is long (ca.ten years), which is discouraging to commercialization.

In situ oil upgrading has several advantages over conventional surface upgrading technologies. Because in situ upgrading (reaction occurring underground) can be implemented on a well-by-well basis, there is no need for large capital-intensive projects. Rather, the size of an in situ project for a particular field can be tailored to available production rates. Thus, in situ upgrading is practical even for those fields deemed too small to provide sufficient production for conventional surface upgrading processing. Additional advantages for in situ upgrading include the production of a more desirable and valuable product, ease in shipping and pipelining (minimum of 22 degree API gravity), and less demanding downstream processing (processable by a conventional refinery).

The requirements for an in situ upgrading process include: provision or a downhole bed of catalyst, achievement of appropriate high reaction temperatures and pressure at the catalyst bed, and mobilization of oil and co-reactants over the catalyst. Although the technologies to accomplish each of these tasks separately are known, their combination into a unified effective underground process has yet to be demonstrated in practice.

Because it is the most efficient method to achieve high temperatures in a reservoir without the direct application of heat, in situ combustion (ISC) is a promising oil recovery process to exploit in the development of an efficient and economical in situ upgrading process.

In-situ combustion processes are applied for the purpose of heating heavy or medium oil to mobilize it and drive it to an open production well for recovery. In general, the usual ISC technique used involves providing spaced apart vertical injection and production wells completed in a reservoir. Typically, an injection well will be located within a pattern of surrounding production wells. Air, or other oxygen-containing gases are injected into the formation. The mixture of air or oxidizing gas and hydrocarbons is ignited, a combustion front is generated in the formation and the resulting combustion front is advanced outwardly toward the production wells. Or, alternately, a row of injection wells may feed air to a laterally extending combustion front which advances as a line drive toward a parallel row of production wells.

In both cases the operator seeks to establish an upright combustion front which provides good vertical sweep and advances generally horizontally through the reservoir with good lateral sweep. However the processes are not easy to operate and are characterized by various difficulties. One such difficulty arises from what is referred to as gravity segregation. The hot combustion gases tend to rise into the upper reaches of the reservoir. Being highly mobile, they tend to penetrate permeable streaks and rapidly advance preferentially through them. As a result they fail to uniformly carry out, over the cross-section of the reservoir, the functions of heating and driving oil towards the production wells. The resulting process efficiency therefore is often undesirably low. Typically the volumetric sweep efficiencies are less than 30%.

Weissman et al (Energy and Fuels. 1996, 10.883,889) have recently proposed a modified in situ combustion process using a vertical well production strategy, in which a catalyst bed is emplaced around the production well. They have reported the results of two ISC tests, from which they concluded that a heated bed of hydrocracker catalyst placed in the bottom section of an 1.8 m long, 0.1 m diameter combustion tube (a special thin-walled reactor to simulate reservoir conditions), was effective in converting carbon monoxide, produced at the combustion front, and water, into carbon dioxide and hydrogen, via the water gas shift reaction. Not only was 50% of the sulphur removed by hydrodesulfurization ("HDS"), but there were also decreases in the oil density and viscosity obtained by the catalytic reaction. However, there were two main problems foreseen with this process: (1) the high retention of oil in the catalyst bed/gravel-pack (a large, one-place volume, with a vertical producer well), would lead to severe coking of the catalyst; and 2) the need to operate in either a cyclic mode (backflow on the injector well), or with a severe gas override condition to provide heat to the catalyst bed. Both processes possibly require supplementary downhole heating, which is both expensive and risky. Also, very importantly, the extremely acidic process gases (carbon dioxide and sulfur dioxide) entering the vertical production well, in combination with a temperature of over 300 degrees Celsius, will cause severe corrosion to the vertical well, through which all production fluids must pass. In the case of deliberate combustion-gas override (which is used to achieve high temperatures at the vertical well), very poor reservoir sweep will be achieved and the possibility of oxygen breakthrough is increased, which could cause a serious explosion hazard. In the case that the proposed cyclic combustion process is used (again to achieve high temperatures at the vertical production well), the production rates will be at least halved because of the required air injection time in the same well. In summary, the two proposed catalytic in situ processes appear expensive and difficult to operate, and so are not felt to be feasible.

A new viscous oil recovery process has recently been developed which provides a substantial increase in reservoir sweep efficiency over that of the traditional ISC process. A combination of wells is used wherein the toes of horizontal production wells are the first segments to provide hydrocarbon production and to come into contact with the injected gases. Greaves and Turta, in U.S. Pat. No. 5,626,191, disclose such a well configuration, which they call the "toe-to-heel" oil displacement process. The patent applies to any process where gases are injected to reduce the viscosity of oil in an underground reservoir, and includes oxidizing gases for in situ combustion, steam injection, steam injection along with other gases, and hydrocarbon solvent gases.

Many oilfield operators are reluctant to apply the in situ combustion process because of historically poor performance when used in a traditional vertical well drive mode, and so an in situ upgrading process that uses steam would be more appealing. Since some heavy or medium gravity oil reserves are found in relatively deep and hot reservoirs, for example in the Orinoco Belt in Venezuela, high temperature steam can be utilized to provide the heat for an in situ upgrading process in some cases.

In summary of the prior art, it has been recognized as very desirable to achieve oil upgrading in an underground reservoir and the ISC process has been proposed as a possible heat source, but an effective process for implementing these steps has not yet been developed. The work underlying the present invention was undertaken to reach this objective. The present invention will now be described.

SUMMARY OF THE INVENTION

Considering the disclosure of U.S. Pat. No. 5,626,191 of Greaves and Turta that:

1. if a generally linear and laterally extending, upright combustion front is established and propagated high in an oil-containing reservoir: and
2. if an open production well is provided having a horizontal leg positioned low in the reservoir so that the well extends generally perpendicularly to and lies in the path of the front and has its furthest extremity ("toe") spaced from but adjacent to the injection sources; then
3. the production well will provide a low pressure sink and outlet that functions to induce the lateral sweep front to advance in a guided and controlled fashion, first intersecting the toe and then proceeding along the length of the horizontal leg - under these circumstances, the oil displacement front will remain generally stable and upright and be characterized by a relatively high reservoir sweep efficiency; and
4. the unreacted injectant gases and reaction gases will flow through the swept portion of the reservoir and through the vertical reaction front and react with the oil at the front. Streamlines of the gases will bend towards the horizontal leg, due to the downward flow gradient created by the action of the production well as a sink, but will also rise due to gravity phase segregation, resulting in a net vertical front advancing laterally without significant over-riding. In the case of steam injection, the condensed water and heated oil will, along with any gases present, likewise flow down to the low pressure sink. In the case of in situ combustion the gases will be combustion gases: carbon monoxide, carbon dioxide, sulphur dioxide and water vapor.

Now, in accordance with the present invention:

if an appropriate oil upgrading catalyst is placed along the horizontal leg of a production well arranged in toe-to-heel configuration, including any of within the leg, on the leg or in the reservoir around the leg; then hot combustion gases from an ISC process, or steam from a steam injection process combined with injected reducing gases, such as carbon monoxide or hydrogen, will react with the commingled oil over the catalyst at appropriate temperature and pressure and the oil will be substantially upgraded.

When compared in experimental runs with a conventional toe-to-heel ("TTH") in situ combustion process in accordance with the Greaves and Turta patent, without catalyst in the vicinity of the horizontal leg of the oil producing well, the present invention was found to be relatively characterized by:

increased average API gravity of produced oil;

reduced oil viscosity;

reduced oxygen and carbon monoxide and increased carbon dioxide levels in the produced gas stream;

extensive hydrodesulfurization of the oil; and extensive hydrodemetallization of the oil.

Additionally, the present process benefits from being a single pass catalytic process so that the reactant oil and gases continuously access fresh catalyst. The distributed catalyst along the horizontal well maintains high conversion activity by virtue of sequential catalyst exposure caused by the advancing movement of the combustion front from the toe to the heel of the horizontal well.

Therefore, in broad terms, the invention is a process for upgrading oil in an underground reservoir while the oil is recovered through a production well, comprising: providing an injection well for injecting a gaseous fluid into the reservoir to form an advancing, laterally extending displacement front operative to reduce the viscosity of reservoir oil; providing at least one open production well having a horizontal leg completed relatively low in the reservoir and positioned substantially perpendicular to and in the path of the advancing front; emplacing oil upgrading catalyst along the leg's length; injecting the gaseous fluid into the injection well and advancing the displacement front along the leg; and producing the production well to recover upgraded oil from the reservoir.

DESCRIPTION OF THE PREFERRED EMBODIMENT

The invention was developed in the course of carrying out an experimental investigation involving test runs carried out in a test cell or three dimensional physical model.

Figure 3A:
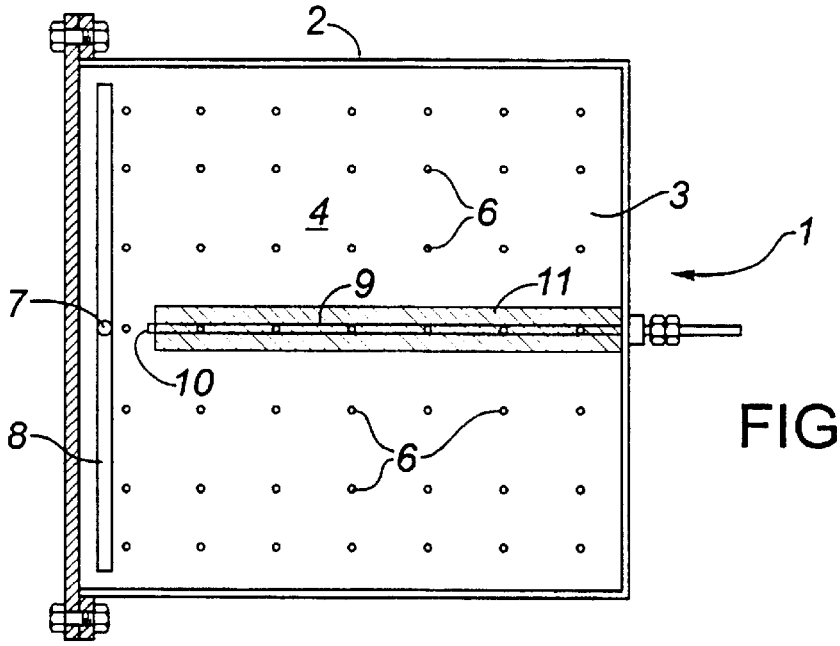
FIGS. 3*a*, 3*b*, 3*c* are top, side and end views of the test cell employed in demonstration of the present invention for the toe-to-heel process when operated in the catalytic upgrading mode in Runs 975 and 976.
Figure 3B:
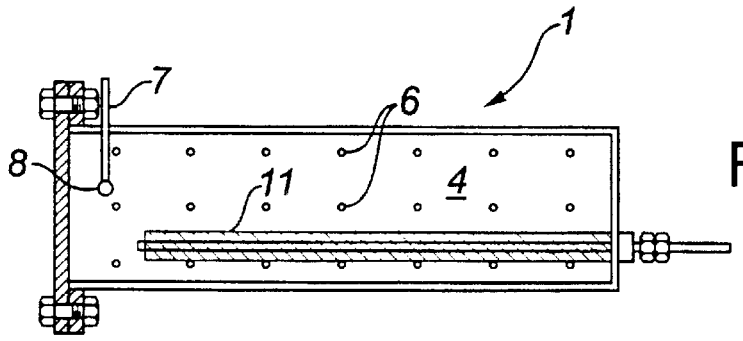
Figure 3C:
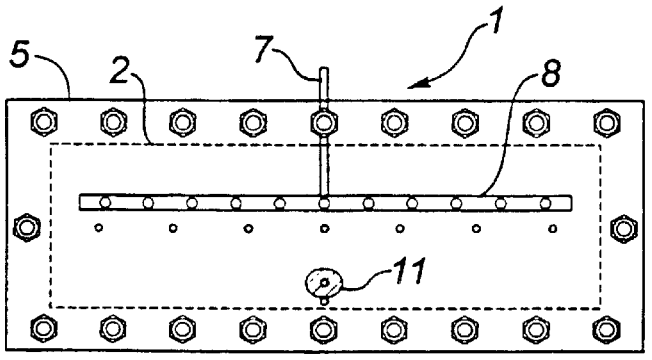

More particularly, a test cell 1, shown in FIGS. 3*a,* 3*b* and 3*c* was provided. The cell comprised a rectangular, closed, thin-walled stainless steel box 2. Dimension-wise, the box 2 formed a chamber 3 having dimensions 40×40×10 cm (total volume 16,000 c.c.). The thickness of each box wall was 4 millimeters. The chamber 3 was filled with a sand pack 4 consisting of a mixture of sand, clay, oil and water. The composition of the uniform mixture charged into the chamber 3 and other bed properties shown below in Table 1.

The porosity of the sand pack 4 was about 38.5% and the permeability was about 1.042 darcys.

The loaded cell box 2 was placed inside a larger aluminum box 5 and the space between them was filled with vermiculite powder insulation.

Sixty type K thermocouples 6, positioned at 6 cm intervals as shown in FIGS. 3*a,* 3*b,* 3*c* and 4, extended through the wall of the cell 1 into the sand pack 4, for measuring the three dimensional temperature distribution in the sand pack 4.

To compensate for heat losses, the cell 1 was wound with heating tape (not shown). This heat source was controlled manually, on demand, in response to the observed combustion peak temperature and adjacent well temperature values. The temperature at the wall of the cell was kept a few degrees Celsius less than the temperature inside the sand, close to the wall. In this way, the quasi-adiabatic character of the run was assured.

A cell heater 7 was embedded in the top section of the sand pack 4 at the air injection end, for raising the temperature in the region of the injection well 8 to ignition temperature.

Simulated air injection wells 8 were provided at the injection end of the cell 1. A simulated production well 9 was provided at the opposite or production end of the cell 1.

For Runs 975 and 976, a 0.25 inch diameter cylindrical catalyst bed was placed around the horizontal leg, whereas, for Runs 971 and 972, which constitute demonstrations of prior art for comparison purposes, the catalyst bed was omitted.

The positioning and vertical or horizontal disposition of the wells 8, 9 are shown schematically in FIGS. 1, 2 and 3*a*–3*c* for the four test runs reported on below. This well configuration is referred to as the direct line drive configuration. However, other well configurations are also contemplated, such as staggered line drive where the vertical injection wells are placed between the horizontal legs, or a horizontal injection well is placed relatively high in the reservoir to simulate the effect of a number of vertical injectors by having periodic perforations as a means to distribute the injectant gas. In the case that the reservoir heating is accomplished by injection of steam, the appropriate location of the steam injectors will be reservoir-specific and may not be high in the reservoir.

Figure 1:
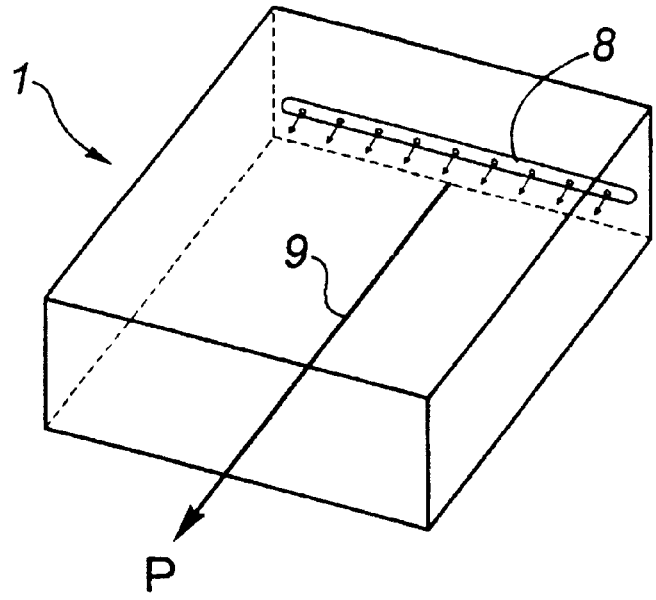
FIG. 1 is a perspective view schematically showing a sand pack with simulated vertical injection wells and a perpendicularly arranged, horizontal production well, said injection wells and production well being completed relatively high and low in the pack, respectively, as in the base case of the Greaves and Turta prior art, and reported below for Runs 971 and 972.
Figure 2:
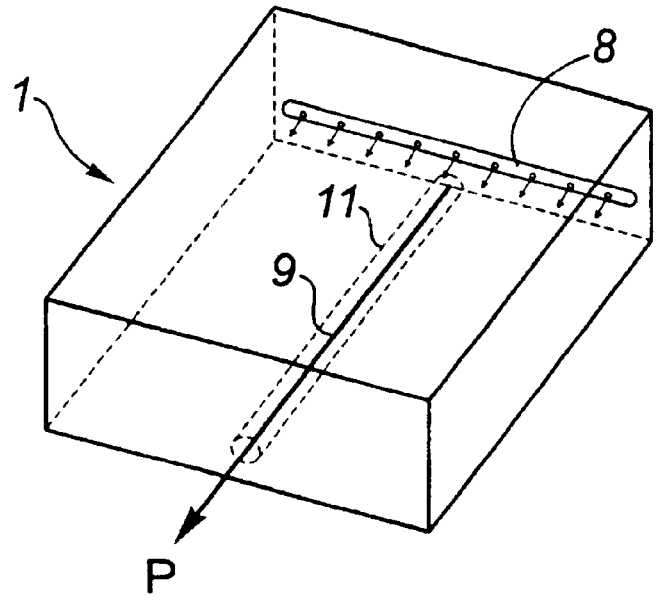
FIG. 2 is a perspective view schematically showing a sand pack with simulated vertical injection wells and a perpendicularly arranged, horizontal production well, said injection wells and production well being completed relatively high and low in the pack, respectively, as in FIG. 1, but with the placement of upgrading catalyst around the horizontal segment of the horizontal well, and reported below for Runs 975 and 976.

As shown in FIG. 1 for non-catalytic Runs 971 and 972, a horizontal injection well 8 was placed relatively high in the cell, while the production well 9 was horizontal and placed relatively low in the test cell with its toe slightly displaced from the injection well. Non-catalytic Runs 971 and 972 were a demonstration of prior art (Greaves and Turta) and were conducted for comparison purposes only. Run 971 was a dry ISC process, and Run 972 was a wet ISC process. There was no catalyst present for these Runs.

As shown in FIGS. 2 and 3*a*–3*c,* for catalytic Runs 975 and 976, a horizontal injection well 8, positioned laterally across the sand pack 4, was provided. The injection well was located relatively high in the sand pack. The production well 9 was horizontal, elongated, positioned low in the sand pack and had its toe adjacent to but spaced from the injection well. The horizontal production well 9 was arranged to be generally perpendicular to a laterally extending combustion front developed at the injection source. However, the toe 10 of the production well was spaced horizontally away from a vertical projection of the injection well. An elongated ring of catalyst, 11, was placed around the horizontal well 9.

The oil upgrading catalyst employed in Runs 975 and 976 was a standard hydrotreating/HDS catalyst manufactured by Akzo Chemie Nederland bv. Amsterdam, and identified as Ketjenfine 742-1, 3AQ.

Each of the injection and production wells 8,9 were formed of perforated stainless steel tubing having a bore 4 mm in diameter. The tubing was covered with 100 gauge wire mesh (not shown) to exclude sand from entering the tubing bore.

Figure 4:
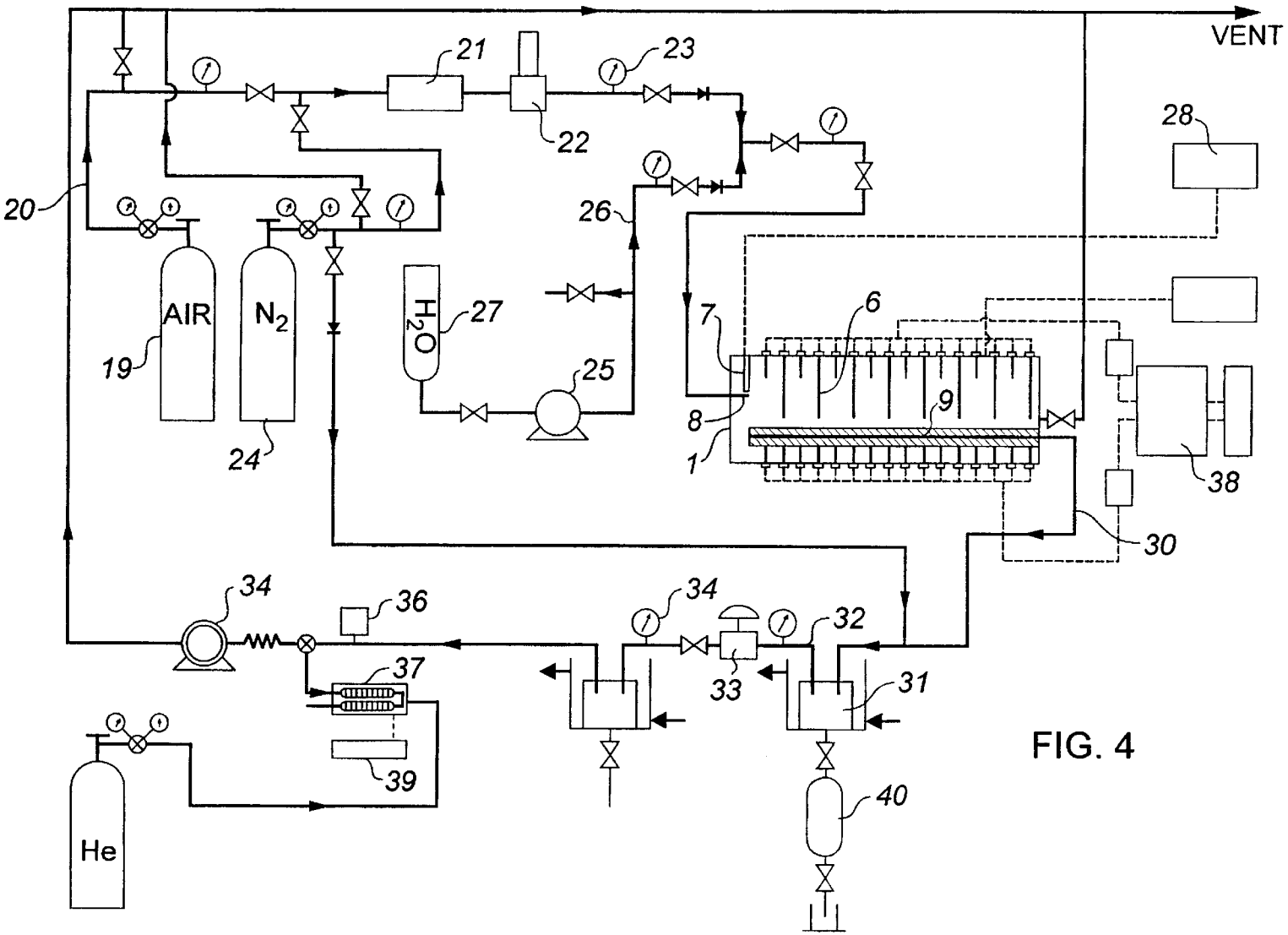
FIG. 4 is a flow diagram showing the laboratory set-up, including the test cell of FIGS. 3*a*–3*c*, used to conduct the experimental runs reported on below.

The combustion cell 1 was integrated into a conventional laboratory system shown in FIG. 4. The major components of this system are now shortly described.

Air was supplied to the injection well 18 from a tank 19 through a line 20. The line 20 was sequentially connected with a gas dryer 21, mass flowmeter 22 and pressure gauge 23 before reaching the injection well 8. Nitrogen could be supplied to the injection well 8 from a tank 24 connected to line 20. Water could be supplied to the injection well 8 from a tank 27 by a pump 25 through line 26. Line 26 was connected with line 20 downstream of the pressure gauge 23. A temperature controller 28 controlled the ignition heater 7. The produced fluids passed through a line 30 connected with a separator 31. Gases separated from the produced fluid and passed out of the separator 31 through an overhead line 32 controlled by a back pressure regulator 33. The regulator 33 maintained a constant pressure in the test cell 1. The volume of the produced gas was measured by a wet test meter 34 connected to line 32. The liquid leaving the separator was collected in a cylinder 40.

Part of the produced gas was passed through an oxygen analyzer 36 and gas chromatograph 37. Temperature data from the thermocouples 6 was collected by a computer 38 and gas composition data was collected from the analyzer 36 and gas chromatograph 37 by an integrator 39.

TABLE 1

| BED PROPERTIES | | | | |
|---|---|---|---|---|
| Run Code | 971 | 973 | 975 | 976 |
| Bed Type | Uncon | Uncon | Uncon | Uncon |
| Sand Type | Silica. W50 | Silica. W50 | Silica. W50 | Silica. W50 |

TABLE 1-continued

| BED PROPERTIES | | | | |
|---|---|---|---|---|
| Run Code | 971 | 973 | 975 | 976 |
| Sand wt % | 97 | 97 | 97 | 97 |
| Clay wt % kaolinite | 3 | 3 | 3 | 3 |
| Porosity % | 38.5 | 38.5 | 38.5 | 38.5 |
| Permeability (md) | 1042 | 1042 | 1042 | 1042 |
| $S_{oi}$ % | 76 | 76 | 76 | 76 |
| $S_{wi}$ % | 17 | 17 | 17 | 17 |
| $S_{gi}$ % | 7 | 7 | 7 | 7 |
| Initial Temperature (Deg C.) | 18 | 17 | 18 | 17 |

Air was injected at a rate of approximately 6.0 l/m. and ignition was initiated using the heater 7. The tests were typically continued for up to 11 hours for the dry ISC Runs 971, 975 and for 7.5 hours for the wet ISC Runs 972, 976. In the runs where water was added, its rate was 0.025 l/m. Details of the operating conditions are provided in Table 2.

TABLE 2

| OPERATING CONDITIONS | | | | |
|---|---|---|---|---|
| Run Code | 971 | 972 | 975 | 976 |
| Combustion Mode | Dry | Wet | Dry | Wet |
| Catalyst | no | no | yes | yes |
| Air flux ($m^3/m^2 \cdot hr$) | 9 | 9 | 9 | 9 |
| Oxygen flux ($m^3/m^2 \cdot hr$) | 1.89 | 1.89 | 1.89 | 1.89 |
| Air Injection Rate (l/min) | 6 | 6 | 6 | 6 |
| Water Air Ratio ($m^3/m^3$) | 0 | 0.0042 | 0 | 0.0042 |
| Water injection rate (l/min) | 0 | 0.025 | 0 | 0.025 |
| Initial Temperature (Deg C.) | 18 | 17 | 18 | 17 |
| Operating pressure (psig) | 25 | 25 | 25 | 25 |
| Well Type | HI-HP | HI-HP | HI-HP | HI-HP |
| Well Configuration | Line Drive | Line Drive | Line Drive | Line Drive |
| Back pressure set point (psig) | 24.4 | 24.3 | 24.5 | 24.4 |

Legend

HI=Horizontal Injector

HP=Horizontal Producer

Following completion of each run, an analysis of the cell sand pack 4 was undertaken to determine the volumetric sweep efficiency. The analysis comprised a physical removal of successive vertical layers of the sandpack at 3 cm intervals and determining the extent of the burned zone by measuring the oil and coke content. In this way the volumetric sweep of the burning front was determined postmortem and compared with that obtained from the peak temperature profiles during the run. The results of the four Runs are set forth in Table 3.

TABLE 3

| SUMMARY OF RESULTS | | | | |
|---|---|---|---|---|
| Run Code | 971 | 972 | 975 | 976 |
| Combustion Mode | Dry | Wet | Dry | Wet |
| Catalyst? | no | no | yes | yes |
| Overall period (hrs) | 12.7 | 7.5 | 12.5 | 7.3 |
| Pre-ignition period (hrs) | 1.98 | 2.00 | 2.30 | 1.98 |
| Air injection period (hrs) | 10.7 | 5.5 | 10.2 | 5.3 |
| Dry phase period (hrs) | 10.7 | 2.4 | 10.2 | 2.6 |
| Wet phase period (hrs) | 0 | 3.1 | 0 | 2.7 |
| Peak temp (dry phase) (deg C.) | 621 | 625 | 629 | 627 |
| Stabilized temp (dry phase) (deg C.) | 452 | 455 | 455 | 451 |
| Peak temp (wet phase) (deg C.) | N/A | 477 | N/A | 468 |
| Stabilized temp (wet phase) (deg C.) | N/A | 393 | N/A | 402 |
| CO2 % (dry stabilized) | 14.3 | 14.2 | 16.5 | 16.5 |
| CO % (dry stabilized) | 4.0 | 4.0 | 2.4 | 2.3 |
| O2 % (dry stabilized) | 1.10 | 1.18 | 0.85 | 0.93 |
| CO2 % (wet stabilized) | N/A | 13.9 | N/A | 17.1 |
| CO % (wet stabilized) | N/A | 3.5 | N/A | 0.3 |
| O2 % (wet stabilized) | N/A | 2.3 | N/A | 1.6 |
| H2 % (calculated for 975 & 976 | N/A | N/A | 1.9 | 5.8 |
| CO/CO + CO2 | 0.220 | 0.200 | 0.130 | 0.017 |
| H/C | 0.73 | 0.71 | 0.44 | 0.33 |
| Air to Fuel requirements (Sm 3/kg) | 9.485 | 9.544 | 9.457 | 9.810 |
| O2 to fuel requirements (Sm 3/kg) | 2.00 | 2.00 | 2.00 | 2.06 |
| Fuel burned (kg) | 0.384 | 0.186 | 0.371 | 0.181 |
| Fuel burned (% of OOIP) | 9.10 | 4.40 | 8.74 | 4.27 |
| Oxygen utilization % (Average) | 94.8 | 89.0 | 96.0 | 92.3 |
| Volumetric sweep efficiency % | 40.7 | 43.0 | 39.0 | 38.7 |
| Fuel combustion (kg/m3) | 65 | 30 | 65 | 32 |
| Air Oil ratio ($m^3/m^3$) | 1328 | 744 | 1428 | 738 |
| Water Air ratio ($m^3/m^3$) | 0 | 0.0042 | 0 | 0.0042 |
| Oil recovery % of OOIP | 67.9 | 62.3 | 60.4 | 53.2 |
| Water recovery % of OOIP | 91.3 | 80.4 | 71.1 | 69.8 |
| Combustion front velocity (m/hr) | 0.016 | 0.024 | 0.015 | 0.022 |

The produced gas analyses provide support for occurrence of the water gas shift reaction in the catalyst zone. The reaction is: CO+H2O=CO2+H2. Comparing the non-catalytic and catalytic dry ISC Runs, 971 and 975 respectively, the CO produced gas is 40% lower for the catalytic case (2.4% vs 4.0%).

Comparing the produced CO for the wet combustion cases, Runs 972 and 976, the CO level is 91% lower when catalyst is present (0.31% vs 3.50%).

The CO2 levels are higher in the two catalyst Runs 975 and 976, compared with the corresponding non-catalytic Runs 971 and 972, which provides further support for the water gas shift reaction as a primary source of hydrogen in catalytic in situ upgrading.

The differences in recovery of the original water in place can be used to calculate the amount of hydrogen produced and consumed during in situ upgrading reactions; the result is 1.91% of the total produced gas phase for Run 975 dry catalytic ISC, and 5.8% for wet catalytic ISC Run 976.

The results described above make it clear that any catalyst that has water gas shift activity would be beneficial and could be employed by itself or in any proportion in admixture with the hydrotreating/HDS catalyst used in Runs 975 and 976 or other such catalyst.

Since the water gas shift reaction produces the hydrogen required for oil upgrading, the process can be carried out by injecting high temperature steam and carbon monoxide. A carbon monoxide source, for example, oxygen-starved combustion of natural gas, will produce a gas elevated in CO which can be injected into the reservoir. In this way the key ingredients for effective in situ upgrading will be provided: these are heat, hydrogen and active catalysts.

Also to be noted as a benefit of catalytic ISC is the lower level of produced oxygen. Since each pair of non-catalytic and catalytic Runs were conducted under the same conditions, the oxygen reduction can be attributed to the presence of catalyst.

The analyses of produced oil are presented in Tables 4 and 5 for API gravity, density and viscosity at each half-hour interval.

The prior art toe-to-heel ISC process of Greaves and Turta provides considerable thermal upgrading as measured by the three aforementioned parameters (Runs 971 and 972), but still fall very short of the performance of the catalytic Runs 975 and 976 of the present invention. The average results are summarized in Table 6. Wet catalytic ISC improved the oil gravity from 11.0 API to 20.7 API and reduced the viscosity from 100,000 cps to 46 cps. Therefore the upgraded oil at a viscosity of 46 cps will be easily pipelined without the need for a diluent. Since diluent light hydrocarbons are expensive and in short supply this is a valuable benefit of the present invention.

TABLE 4

DRY NORMAL AND CATALYTIC

| | Run 971 (Dry Normal) | | | Run 975 (Dry Catalytic) | | |
|---|---|---|---|---|---|---|
| Time | API | Density | Viscosity | API | Density | Viscosity |
| 0.5 | 11.0 | 0.993 | 100000 | 11.0 | 0.993 | 100000 |
| 1 | 11.0 | 0.993 | 100000 | 11.3 | 0.991 | 97780 |
| 1.5 | 11.0 | 0.993 | 100000 | 14.2 | 0.971 | 8220 |
| 2 | 11.1 | 0.992 | 98873 | 14.6 | 0.969 | 7830 |
| 2.5 | 12.4 | 0.983 | 20234 | 20.6 | 0.930 | 40 |
| 3 | 12.8 | 0.981 | 14060 | 20.5 | 0.931 | 43 |
| 3.5 | 15.3 | 0.964 | 7435 | 19.8 | 0.935 | 62 |
| 4 | 14.8 | 0.967 | 7675 | 19.5 | 0.937 | 68 |

TABLE 4-continued

DRY NORMAL AND CATALYTIC

| | Run 971 (Dry Normal) | | | Run 975 (Dry Catalytic) | | |
|---|---|---|---|---|---|---|
| Time | API | Density | Viscosity | API | Density | Viscosity |
| 4.5 | 14.5 | 0.969 | 8020 | 19.3 | 0.938 | 74 |
| 5 | 14.1 | 0.972 | 8430 | 19.2 | 0.939 | 82 |
| 5.5 | 14.3 | 0.971 | 8160 | 18.9 | 0.941 | 97 |
| 6 | 14.0 | 0.973 | 8570 | 18.6 | 0.943 | 104 |
| 6.5 | 13.8 | 0.974 | 9010 | 18.4 | 0.944 | 111 |
| 7 | 13.7 | 0.945 | 9035 | 18.3 | 0.945 | 117 |
| 7.5 | 13.9 | 0.973 | 8660 | 18.2 | 0.945 | 123 |
| 8 | 14.0 | 0.973 | 8550 | 18.5 | 0.943 | 106 |
| 8.5 | 13.8 | 0.974 | 8990 | 18.0 | 0.946 | 133 |
| 9 | 13.6 | 0.975 | 9050 | 18.3 | 0.945 | 118 |
| 9.5 | 13.2 | 0.978 | 9780 | 18.4 | 0.944 | 110 |
| 10 | 13.4 | 0.977 | 9580 | 18.2 | 0.945 | 123 |
| 10.5 | 13.5 | 0.976 | 9440 | 18.3 | 0.945 | 118 |
| 11 | 13.3 | 0.977 | 9630 | 18.1 | 0.946 | 129 |
| 11.5 | 13.4 | 0.977 | 9560 | 18.0 | 0.946 | 132 |
| 12 | 13.1 | 0.979 | 9820 | 18.3 | 0.945 | 118 |
| 12.5 | 13.2 | 0.978 | 9770 | 18.4 | 0.944 | 109 |
| Average (3.5–12.5 hrs) | 13.8 | 0.972 | 8903 | 18.7 | 0.948 | 101 |

TABLE 5

WET NORMAL AND CATALYTIC

| | Run 971 (Dry Normal) | | | Run 975 (Dry Catalytic) | | |
|---|---|---|---|---|---|---|
| Time | API | Density | Viscosity | API | Density | Viscosity |
| 0.5 | 11.0 | 0.993 | 100000 | 11.0 | 0.993 | 100000 |
| 1 | 11.0 | 0.993 | 100000 | 11.7 | 0.988 | 95760 |
| 1.5 | 11.0 | 0.993 | 100000 | 13.4 | 0.977 | 10043 |
| 2 | 11.2 | 0.967 | 99020 | 15.1 | 0.965 | 6320 |
| 2.5 | 14.8 | 0.971 | 7690 | 19.8 | 0.935 | 65 |
| 3 | 14.2 | 0.975 | 8210 | 20.4 | 0.932 | 46 |
| 3.5 | 13.7 | 0.976 | 9015 | 19.7 | 0.936 | 63 |
| 4 | 13.5 | 0.974 | 9460 | 19.6 | 0.936 | 65 |
| 4.5 | 13.8 | 0.977 | 9000 | 19.4 | 0.938 | 72 |
| 5 | 13.4 | 0.977 | 9560 | 22.2 | 0.930 | 24 |
| 5.5 | 13.2 | 0.978 | 9760 | 20.7 | 0.921 | 37 |
| 6 | 12.5 | 0.983 | 10170 | 21.4 | 0.925 | 31 |
| 6.5 | 13.0 | 0.979 | 9900 | 20.7 | 0.930 | 37 |
| 7 | 12.9 | 0.980 | 9960 | 21.0 | 0.928 | 33 |
| 7.5 | 12.8 | 0.981 | 10040 | 21.3 | 0.926 | 32 |
| Average (2.5–7.5 hrs) | 13.4 | 0.980 | 9342 | 20.6 | 0.931 | 46 |

TABLE 6

SUMMARY OF UPGRADING RESULTS (AVERAGES)

| Run # | Condition | API Gravity | Density g/cc | Viscosity mPa · s |
|---|---|---|---|---|
| Base | no ISC | 11.0 | 0.993 | 100,000 |
| 971 | Dry Normal | 13.8 | 0.972 | 8,903 |
| 975 | Dry Catalytic | 18.7 | 0.948 | 101 |
| 972 | Wet Normal | 13.4 | 0.980 | 9,342 |
| 976 | Wet Catalytic | 20.7 | 0.931 | 46 |

Further important upgrading benefits are demonstrated in Table 7, where XT004466 is clean dry Wolf Lake crude oil which was used in the four test Runs 971, 972, 975 and 976, and XT004467 is produced oil from the wet catalytic Run 976 of the present invention.

An extensive desulfurization and demetalization of the base oil was achieved in the catalytic Run 976 of the present invention. Sulfur was reduced 88% from 43,400 ppm to 5,100 ppm; nickel 96% from 73 ppm to 3 ppm and vanadium 96% from 195 ppm to 8 ppm. Other metals, such as iron and molybdenum were also partially removed in the catalytic process. It should be noted that the increase in silicon is not a consequence of the presence of catalyst: all high temperature steam processes give rise to elevated silicon levels.

TABLE 7

OIL SULFUR AND METAL ANALYSIS (by ICP, mg/kg)

| Sample ID<br>Customer ref: | XT004466 (10 API)<br>Base Wolf Lake oil | XT004467 (20.7 API)<br>Run 976 product |
|---|---|---|
| Silver | <1 | <1 |
| Aluminum | <1 | <1 |
| Boron | 2 | 3 |
| Barium | <1 | <1 |
| Calcium | 2 | 2 |
| Chromium | <1 | <1 |
| Copper | <1 | <1 |
| Iron | 5 | <1 |
| Potassium | <8 | <8 |
| Magnesium | 1 | <1 |
| Manganese | <1 | <1 |
| Molybdenum | 7 | 3 |
| Sodium | <6 | <6 |
| Nickel | 73 | 3 |
| Phosphorus | <2 | <2 |
| Lead | <2 | <2 |
| Sulphur | 43400 | 5100 |
| Silicon | 1 | 69 |
| Tin | <2 | <2 |
| Titanium | 1 | <1 |
| Vanadium | 195 | 8 |
| Zinc | 2 | 5 |

Figure 5A:
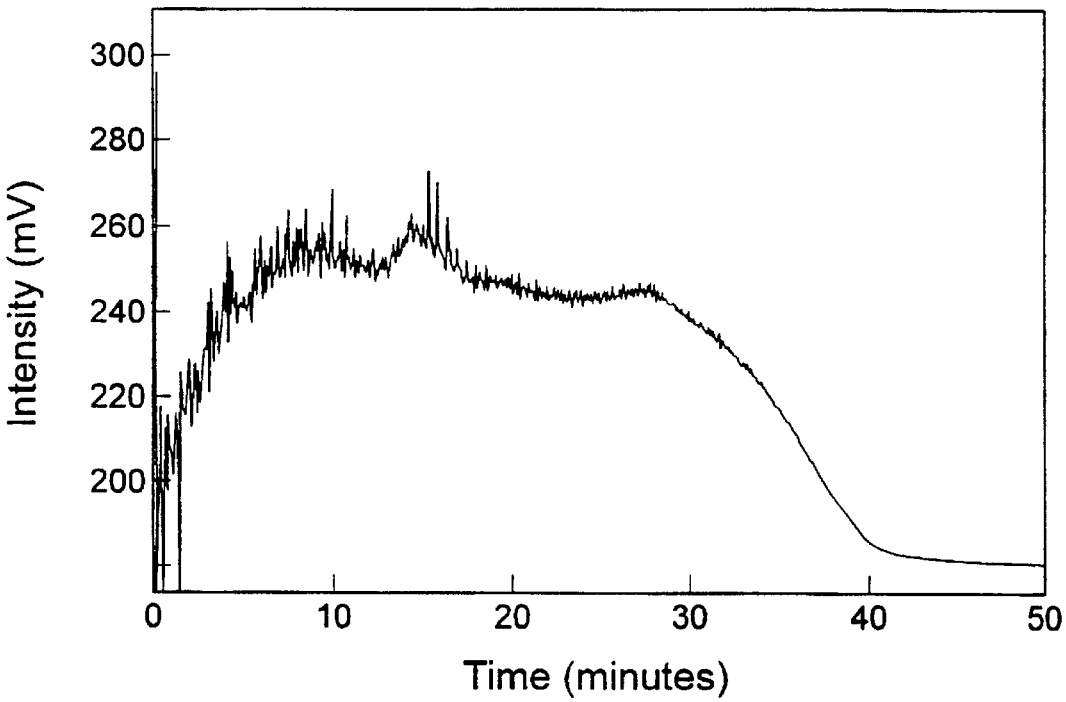
FIGS. 5*a* and 5*b* show gas chromatographic spectra for Wolf Lake crude oil used in the test runs, and produced oil from the catalytic wet ISC Run 976 of the present invention, respectively.
Figure 5B:
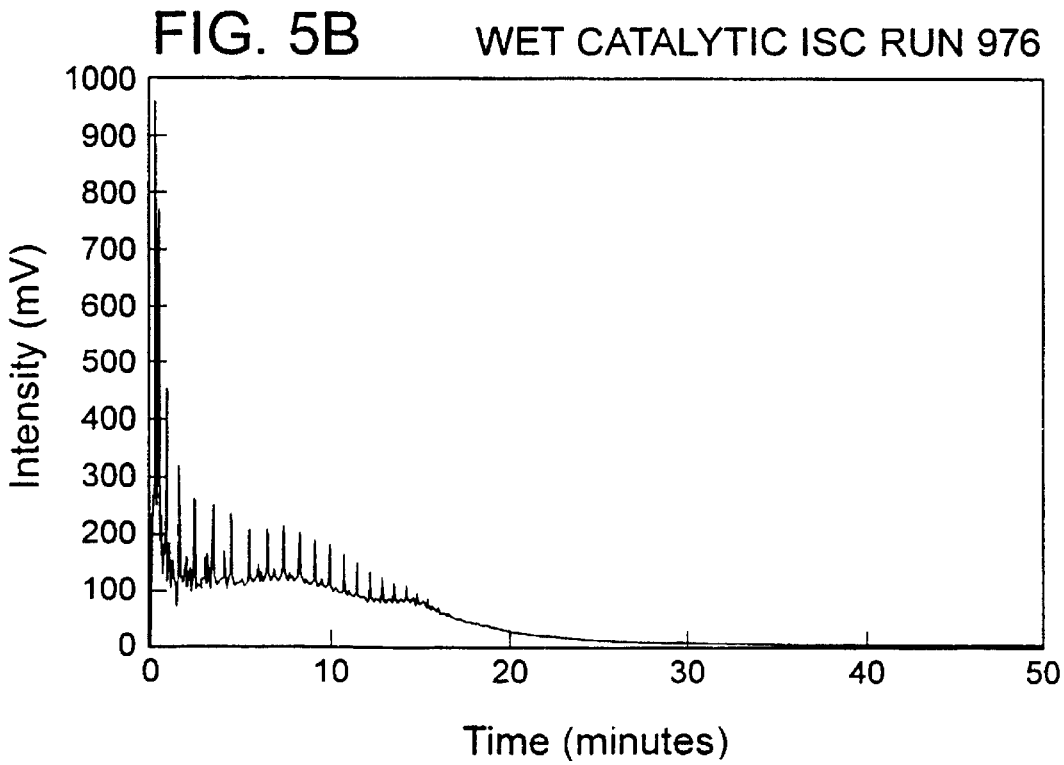

FIG. 5 shows gas chromatographic analyses of samples XT 004466 Wolf Lake crude oil and Run 976 wet catalytic ISC product. Very extensive oil upgrading is apparent from the large decrease in heavy components observed in the catalytic Run.

The wet combustion test of Run 976 demonstrated the preferred form of the invention. Either moderate wet combustion or superwet combustion may be applied. However, in oil reservoirs where water injectivity is too low, the catalytic dry combustion process may be applied as well.

Test of NCC Type Catalyst

Run 986 was conducted using NCC catalyst placed around the horizontal leg of the producer for the purpose of comparison with an otherwise identical non-catalytic Run 985.

The original test cell was modified to have 6-band heaters and computer control to provide a better approach to adiabatic conditions.

The catalytic Run 986 used the catalyst FCC-RESOC-1 BU, a rare earth alumino silicate supplied by Grace Davison, and having the following physical characteristics.

| | |
|---|---|
| Composition | 42% Al2O3, 1.0% Rare Earth oxide, 0.2% Na2O |
| Surface area (square meters/gm) | 300 |
| Bulk density (g/ml) | 0.7 |
| Average particle size (microns) | 72 |

Results showed that the Run 986 with NCC catalyst produced Wolf Lake oil (11 API) of 21.0 degrees API, which was 7 degrees API higher than the thermally cracked oil in the absence of catalyst in Run 985.

The effect of vertical heterogeneity of the reservoir on fluid channeling was tested in a specially-packed cell in Run 7. Three layers of sand were packed sequentially using fine, coarse and fine-grained sands to see whether air would advance ahead of the vertical combustion front in the high-permeability central layer. Table 8 gives the details of the stratified model. FIGS. 8*a*–8*f* shows the results in terms of thermal contours. The vertical axis represents temperature in all cases. Lowest temperatures are shown in dark color. The combustion front remained substantially vertical, with no preferred advancement into the central zone. The explanation may be that the vertical drainage of the hot cracked oil provides a "self-healing" phenomenon where air advancement into the central high permeability streak is blocked by draining oil. This demonstrates that the process of the present invention has a major advantage over processes of the prior art in which both the injected air and produced fluids flow substantially horizontally between vertical wells and fingering of air into high permeability layers causes early oxygen breakthrough and safety hazards. Layers of varying permeability are a very common feature of clastic reservoirs and often prohibits the use of traditional in situ combustion as an oil recovery process. The present invention removes this limitation.

TABLE 8

RUN 7
DRY IN SITU COMBUSTION IN A STRATIFIED MODEL;
CLAIR OIL, 19.8 API, 200 CPS AMBIENT

| Layer | Sand Grain Size | Permeability MD |
|---|---|---|
| Top | fine | 616 |
| Middle | coarse | 3000 |
| Bottom | fine | 616 |

Figure 6:
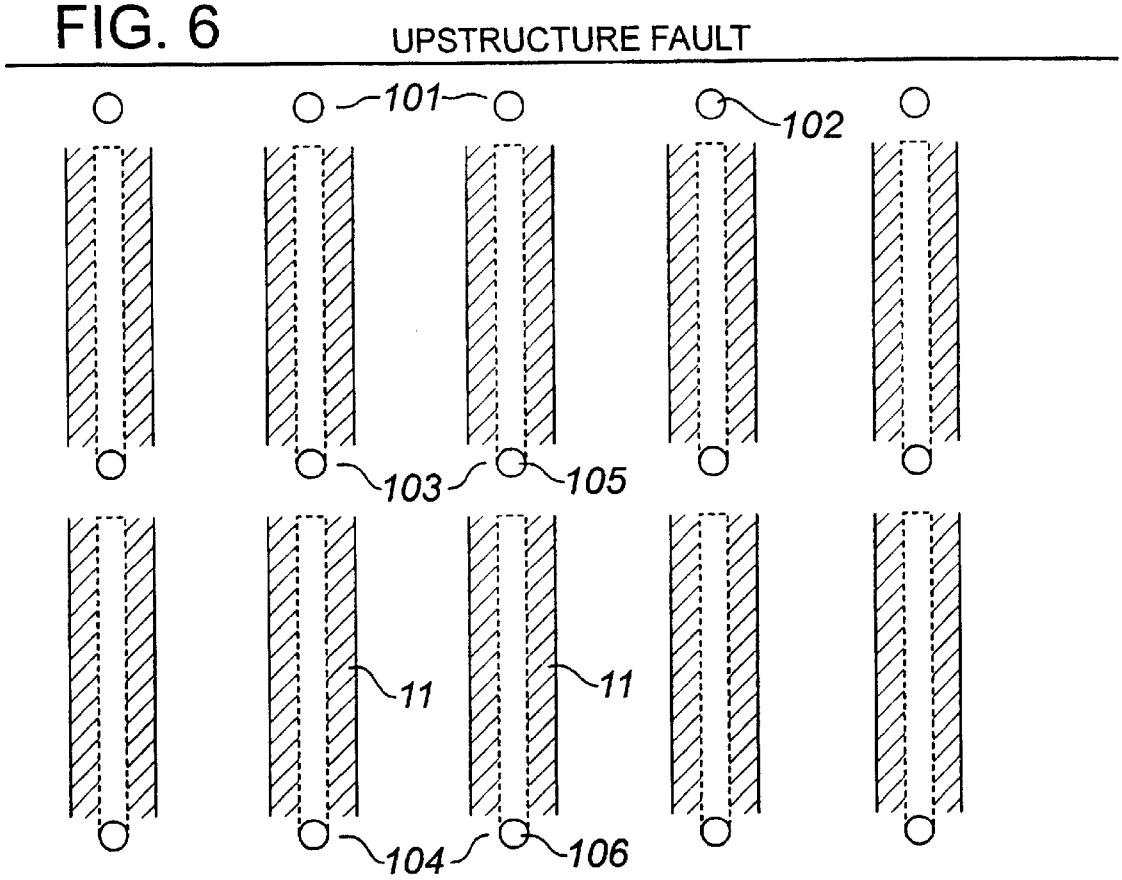
FIG. 6 is a plan view showing a preferred field embodiment of the well layout.
Figure 7:
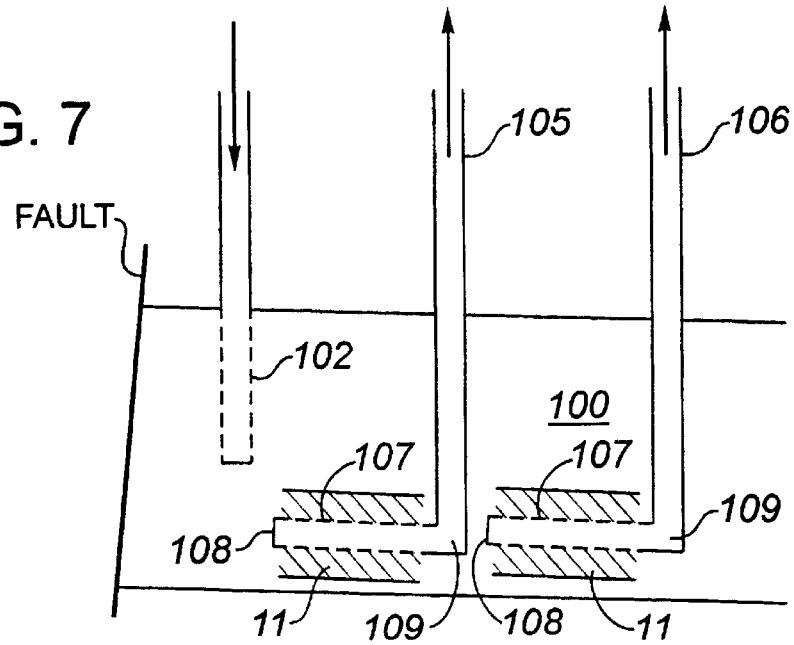
FIG. 7 is a side cross-section taken along the line XII—XII of the well arrangement of FIG. 6.
Figure 8A:
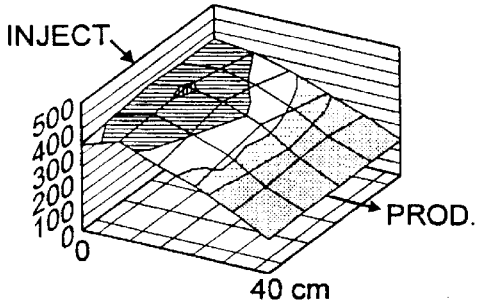
FIGS. 8*a,* 8*c* and 8*e* are horizontal thermal contour plots for three layers in the sand pack after 6 hours of operation during Run 7—FIGS. 8*b,* 8*d* and 8*f* are vertical cross-section thermal contour plots.
Figure 8B:
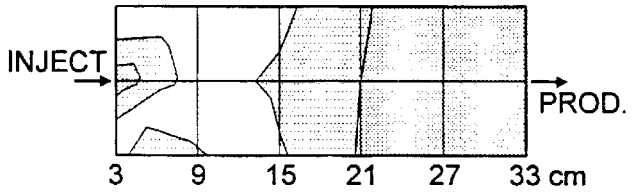
Figure 8C:
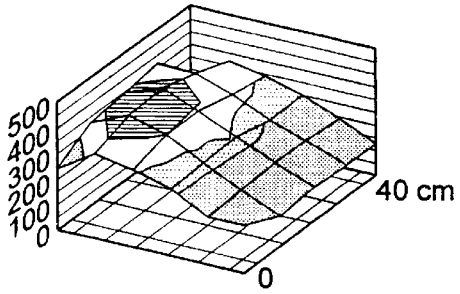
Figure 8D:
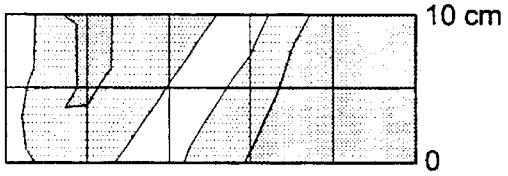
Figure 8E:
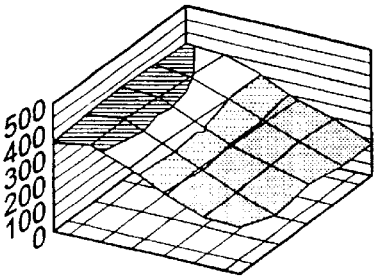
Figure 8F:
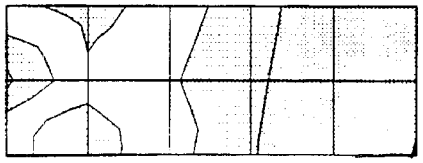

In the preferred field embodiment of the invention, the direct line-drive application illustrated in FIGS. 6 and 7, a reservoir 100 is characterized by a downward dip and lateral strike. A row 101 of vertical air-water injection wells 102 is completed high in the reservoir 100 along the strike. At least two rows 103, 104 of production wells 105, 106 having generally horizontal legs 107, are completed low in the reservoir and down dip from the injection wells, with their toes 108 closest to the injection wells 102. The toes 108 of the row 103 of production wells 105 are spaced down dip from a vertical projection of the injection wells 102. Catalyst particles are emplaced along the horizontal well by a well-known operation called "gravel packing". The second row 104 of production wells 106 is spaced down dip from the first row 103, and is similarly gravel packed. Generally, the distance between wells, within a row, is considerably lower than the distance between adjacent rows. In the first phase of the process, a generally linear combustion front is generated in the reservoir 100 by injecting air or air-water through every second well 102. Preferably a generally linear lateral combustion front is developed by initiating combustion at every second well and advancing these fronts laterally until the other wells are intercepted by the combustion front and by keeping the horizontal production wells closed. Then, air is injected through all the wells 102 in order to link these separate fronts to form a single front. Only during this initiation phase of the field exploitation process, and only once in the lifetime of a producing reservoir, is non-upgraded oil produced. The front is then propagated by injecting air and water down dip toward the first row 103 of production wells 105. The horizontal legs of the production wells 105 are generally perpendicular to the front. The production wells 105 are open during this step, to create a low pressure sink to induce the front to advance along their horizontal legs 107 and to provide an outlet for the heated oil. When the front approaches t he heel 109 of each production well 105, the well is closed in. The horizontal legs 106 (107) of the closed-in wells 105 are then filled with cement. The wells 105 are then perforated high in the reservoir 100 and converted to air-water injection, thereby continuing the propagation of a combustion front toward the second row 104 of production wells 106. Preferably, the first row 101 of injection wells is converted to water injection for scavenging heat in the burnt out zone and bringing it ahead of the combustion zone. This process is repeated as the front progresses through the various rows of production wells. By the practice of this process, a guided combustion front is caused to move through the reservoir with good volumetric sweep efficiency, and the production of upgraded oil.

The embodiments of the invention in which an exclusive property or privilege is claimed are defined as follows:

1. A process for upgrading hydrocarbons in-situ in an underground reservoir having hydrocarbons, comprising the steps of:

(a) providing at least one injection well for injecting an oxidizing gas into the underground reservoir;

(b) providing at least one production well having a substantially horizontal leg and a substantially vertical production well connected thereto, wherein the substantially horizontal leg extends toward the injection well, the horizontal leg having a heel portion in the vicinity of its connection to the vertical production well and a toe portion at the opposite end of the horizontal leg, wherein the toe portion is closer to the injection well than the heel portion;

(c) providing an oil upgrading catalyst between the toe portion and the heel portion substantially coextensive with at least a portion of the horizontal leg;

(d) injecting the oxidizing gas through the injection well for in-situ combustion, so that combustion gases are produced;

(e) thermally upgrading the hydrocarbons in a first in-situ upgrading phase of the process, wherein the combustion gases initially contact the hydrocarbons in the vicinity of the toe portion of the horizontal leg;

(f) catalytically upgrading at least a portion of the hydrocarbon thermally upgraded in step (e) in a second in-situ upgrading phase of the process, wherein at least a portion of the hydrocarbons thermally upgraded in step (e) and at least a portion of the combustion gases initially contact the oil upgrading catalyst in the vicinity of the toe portion of the horizontal leg; and (g) progressively thermally and catalytically upgrading hydrocarbons, wherein (i) the combustion gases progressively advance as a front, substantially perpendicular to the horizontal leg, in a direction from the toe portion to the heel portion and (ii) the oil upgrading catalyst is progressively consumed substantially in a direction from the toe portion to the heel portion of the horizontal leg.

2. The process of claim 1 wherein the oil upgrading catalyst is provided in packing around the horizontal leg of the production well.

3. The process of claim 1 wherein the horizontal leg of the production well is coated with the oil upgrading catalyst.

4. The process of claim 1 wherein the oil upgrading catalyst is provided in packing inside the horizontal leg of the production well.

5. The process of claim 1 wherein the oil upgrading catalyst comprises a hydrodesulfurizing catalyst.

6. The process of claim 1 wherein a water-gas shift catalyst is used in combination with the oil upgrading catalyst.

7. The process of claim 1 wherein the oxidizing gas comprises air.

8. The process of claim 1 wherein a reducing gas is injected through the injection well.

9. The process of claim 8 wherein the reducing gas is selected from carbon monoxide, hydrogen and a combination thereof.

10. The process of claim 1 wherein a substantially linear array of substantially vertical injection wells is used for injecting oxidizing gas.

11. The process of claim 10 wherein the reservoir extends downwardly at an angle to have a dip and a strike, the injection wells extend generally along the strike and the horizontal leg of the production well extends generally along the dip.

12. The process of claim 10 wherein the reservoir extends downwardly at an angle to have a dip and a strike, a plurality of production wells, each connected to horizontal legs, are provided in at least two spaced apart rows parallel with the array of injection wells, and the rows of injection wells and production wells extend generally along the strike and the horizontal legs of the production wells extend generally along the dip.

13. The process of claim 12 wherein the wells are arranged in a staggered line.

14. The process of claim 12 wherein the wells are arranged in a direct line drive configuration.

15. The process of claim 12, further comprising the steps of:

(h) closing each production well in the first row as the combustion front approaches the heel of its respective horizontal leg;

(i) filling the horizontal legs of the closed production wells in the first row with cement;

(j) re-completing the wells relatively high in the reservoir and converting them to injection wells for injecting oxidizing gas; and (k) repeating steps (d) through (g).

16. The process of claim 1 wherein the injection well is a horizontal well having a horizontal portion perpendicular to the horizontal leg of the production well.

* * * * *